252-99 AU 165 EX
11/29/77 XR 4,060,494

United States Patent [19]
Schoenholz et al.
[11] 4,060,494
[45] Nov. 29, 1977

[54] NON-CAUSTIC DRAIN CLEANER

[75] Inventors: Daniel Schoenholz, Basking Ridge; Arthur W. Petersen, Chatham Township, Morris County, both of N.J.

[73] Assignee: Foster D. Snell, Inc., Florham Park, N.J.

[21] Appl. No.: 586,188

[22] Filed: June 12, 1975

[51] Int. Cl.² ..... C11D 7/54
[52] U.S. Cl. ..... 252/105; 134/2; 134/42; 252/94; 252/95; 252/99
[58] Field of Search ..... 252/105, 94, 95, 99; 134/42, 2

[56] References Cited

U.S. PATENT DOCUMENTS

| | | | |
|---|---|---|---|
| 1,688,540 | 10/1928 | Franko et al. | 252/105 |
| 3,262,883 | 7/1966 | Fisher | 252/105 X |
| 3,434,796 | 3/1969 | Colombo et al. | 252/105 X |
| 3,632,516 | 1/1972 | Antonelli et al. | 252/105 X |
| 3,873,696 | 3/1975 | Randeri | 252/94 X |

*Primary Examiner*—Mayer Weinblatt
*Attorney, Agent, or Firm*—Hammond & Littell

[57] ABSTRACT

A non-caustic drain cleaner which acts by generating heat at the site of the clogging comprising a mixture of peroxygen oxidizing agent and a water-soluble reducing agent and to a method of restoring normal flow to clogged drains.

5 Claims, No Drawings

NON-CAUSTIC DRAIN CLEANER

STATE OF THE ART

Drain cleaners sold for domestic use can be legitimately described as being among the most hazardous of cleaning and maintenance aids available to the consumer. Caustic cleaners, which have for years formed a majority of the commerical drain cleaner products, have been identified as the most frequent cause of accidental deaths among non-drug chemical products in the home. The need for a relatively potent detersive force is apparent when one considers the relatively conglomerate make-up of the soil that is to be removed. While the make-up of soil line clogs will vary somewhat with their location, the majority of both bathroom and kitchen drain line stoppages are due to accumulations of organic matter such as hair, grease and food particles. The time honored approach to removing such clogs has been to stimulate their digestion by the addition of a strong caustic solution. The strong alkali saponifies whatever fatty matter is present, converting it to either a water soluble soap or a soft, water dispersible mass. Hair and cellulosic fibers are softened to a more liquid state or dissolved. Additionally, the popular solid caustic products contain a small amount of aluminum dross or turnings which react exothermically in solution with the caustic thus providing enough heat to at least partially melt grease clogs. U.S. Pat. Nos. 2,997,444 and 3,576,751 are examples of these products.

Although the more popular liquid and solid products have been those based on caustic soda or potash, attempts have been made to market products based on acids, organic solvents and enzymes. Another example of this type of product is described in U.S. Pat. No. 3,791,977 which uses a solid acid agent admixed with a caustic agent. Certainly the hazard attending the use of acid based products is at least equivalent to that of the caustic products. Solvent based products, typically containing chlorinated hydrocarbons and petroleum distillates, present less of a total hazard to the consumer but nonetheless require a "Harmful or Fatal If Swallowed" warning label. Enzymatic cleaners present no known hazard but are of no practical use when an immediate remedy is sought.

OBJECTS OF THE INVENTION

It is an object of the invention to provide a novel non-cuastic drain cleaner with the active agent being a mixture of a water-soluble reducing agent and a peroxygen oxidizing agent.

It is another object of the invention to provide a novel method of cleaning clogs from drains with a non-caustic, thermally acting cleaner.

These and other objects and advantages of the invention will become obvious from the following detailed description.

THE INVENTION

The novel non-caustic drain cleaner of the invention comprising a mixture of peroxygen oxidizing agent and a water-soluble reducing agent in approximately stochiometric amounts. Stochiometric amounts of the components is preferred to obtain a maximum amount of heat generated but compositions with a 10 to 15% excess of either component are within the scope of the invention.

Examples of suitable peroxygen oxidizing agents are alkali metal monopersulfates such as potassium monopersulfate compound sold under the trademark Oxone, sodium persulfate; alkali metal percarbonates such as sodium percarbonate sold under the trademark Perdox; and alkali metal perborates such as sodium perborate tetrahydrate and sodium perborate monohydrate. For storage stability, it is preferred to use ingredients containing a minimum of hydration.

The compositions of the invention are functionally as effective as the strongly caustic compositions now on the market but are more safe to handle as they are not strongly acid or strongly alkaline. The two components are stable during storage and are activated by the water in the clogged drain and the exothermic reaction provides sufficient heat to soften and loosen drain clogs. The pressure provided by the head of water above the clog is sufficient to force out the loosened clog and free the drain.

Examples of suitable water-soluble reducing agents are alkali metal sulfites such as sodium sulfite or potassium sulfite; alkali metal thiosulfates such as sodium thiosulfate and potassium thiosulfate; thiourea or thiodiglycol.

The novel method of the invention for unclogging clogged drains comprising adding to a clogged drain an effective amount of a composition comprising a mixture of a peroxygen oxidizing agent and a water-soluble reducing agent in approximately stochiometric amounts. The heat of the exothermic reaction resulting from the addition to the water head above the clog softens and loosens the plug material which is then forced out by the water pressure.

The usual effective amount is 30 to 100 grams, preferably 40 to 65 grams, of the composition which is approximately the same as that used with the caustic cleaners now on the market.

In the following examples there are described several preferred embodiments to illustrate the invention. However, it should be understood that the invention is not intended to be limited to the specific embodiments.

EXAMPLE 1

The following compositions of the invention were prepared with stoichiometric ratios of oxidizing agent to reducing agent with the percentages being based on weight of the composition. Example A was 73.8% of Oxone [potassium monopersulfate] and 26.2% of sodium sulfite; Example B was 49.4% of Perdox [sodium percarbonate] and 50.6% of sodium sulfite; Example C was 44.1% of sodium sulfite and 55.9% of sodium perborate.$4H_2O$.

The above materials were dry blended to provide homogeneous mixes which were packaged in air tight containers to preserve their stability. The dosage rate used in evaluating their performance was 50 grams of product in 200 ml of water which closely approximates the dosage commonly recommended by the dry, caustic based drain cleaners.

To demonstrate the effectiveness of the compositions of the invention, a mixture of synthetic clogging material were prepared consisting of 85 parts by weight of edible tallow and 15 parts by weight of stearic acid (plug No. 1) or 90 parts by weight of plug No. 1, 3 parts by weight of hair clipping and 7 parts by weight of coffee grounds (plug No. 2). Clogging of an S-shaped trap with a diameter of 1½ inches was effected by first filling the U-bend thereof with hot water and adding a sufficient amount of the molten plug to the hot water either on the inlet or sewer side of the U-bend to form a clog 1 inch deep. When the clog solidified, a 200 ml head of water was added through the inlet side of the trap and the clog was then aged at room temperature for 24 hours.

A thermometer was positioned either immediately above the inlet side plug or in the U-bend when the plug is on the sewer side. Then, 50 g of the drain cleaning composition was added to the 200 ml of water and the maximum reaction temperature and the time to break through the plug was recorded and is in Table I for plug No. 1 and No. 2.

TABLE I

| Plug No. | Example | Time for plug breakthrough in min. | Highest Temp. ° F | Temperature at breakthrough ° F |
|---|---|---|---|---|
| | A | 2 | 170 | 140 |
| | B | 2 | 180 | 170 |
| 1 inlet | C | 5 | 190 | 130 |
| side | D | 2 | 210 | 210 |
| | A | 4 ½ | 170 | 130 |
| | B | 4 ½ | 185 | 160 |
| 1 sewer | C | 7 ½ | 190 | 120 |
| side | D | 2 ½ | 210 | 210 |

D is a commercial product based on sodium hydroxide (dry) containing aluminum turnings. Similar tests were effected with plug No. 2 on both inlet side and sewer side of the trap and essentially the same results were obtained. The said results show that addition of the usual amount of drain cleaner of the invention to a head of water located in front of a drain stoppage was effective in removal of the stoppage within a reasonable time and restoration of free flow of water through the drain. Obviously, the compositions of the invention need not be preblended and if desired, the oxidizing agent and the reducing agent may be separately packaged and mixed just before use or at the time of use.

EXAMPLE 2

To determine the stability of the compositions of the invention, Examples A, B and C were stored for 1 month in sealed polyethylene bags and in Drano-type cans at room temperature, and in ovens set at 100° F, at 120° F, at 80° F with 80% relative humidity and then tested for effectiveness by the method described in Table I. Examples A and B were shown to be satisfactory and in Example C, the two components had reacted somewhat but replacement of sodium perborate tetrahydrate with sodium perborate monohydrate gave a stable, effective composition.

Various modifications of the compositions and method of the invention may be made without departing from the spirit or scope thereof and it is to be understood that the invention is to be limited only as defined in the appended claims.

We claim:

1. A method of unclogging clogged drains comprising contacting a clog in a clogged drain with an amount sufficient to soften and loosen the clog by generated heat of approximately stochiometric amounts of an inorganic per oxygen oxidizing agent and a water-soluble reducing agent.

2. The method of claim 1 wherein the amount of the composition in claim 1 is 30 to 100 g.

3. The method of claim 1 wherein the reducing agent is selected from the group consisting of alkali metal sulfites, alkali metal thiosulfates, thiourea and thiodiglycol.

4. The method of claim 3 wherein the peroxygen oxidizing agent is selected from the group consisting of alkali metal perborates, alkali metal percarbonates and alkali metal persulfates.

5. The method of claim 4 wherein the alkali metal sulfite is sodium sulfite.

* * * * *